US006530530B1

(12) United States Patent
Peterson

(10) Patent No.: US 6,530,530 B1
(45) Date of Patent: Mar. 11, 2003

(54) DECORATIVE FOUNTAIN

(75) Inventor: Joseph C. Peterson, Carmel, IN (US)

(73) Assignee: Crown Technology, Inc., Indianapolis, IN (US)

( * ) Notice: Subject to any disclaimer, the term of this patent is extended or adjusted under 35 U.S.C. 154(b) by 0 days.

(21) Appl. No.: 10/159,440

(22) Filed: May 31, 2002

Related U.S. Application Data

(63) Continuation-in-part of application No. 29/160,953, filed on May 20, 2002.

(51) Int. Cl.[7] ..... B05B 17/08

(52) U.S. Cl. ..... 239/17; 239/23; 239/211; 222/78

(58) Field of Search ..... 222/78; 239/16, 239/17, 20, 23, 211

(56) References Cited

U.S. PATENT DOCUMENTS

| | | | | | |
|---|---|---|---|---|---|
| 996,929 | A | | 7/1911 | Kempinski | |
| 1,041,149 | A | | 10/1912 | Nichols | |
| 1,064,873 | A | | 6/1913 | Thowless | |
| 1,309,375 | A | | 7/1919 | Taylor | |
| 1,536,188 | A | | 5/1925 | Brown | |
| 1,672,910 | A | | 6/1928 | Saalburg | |
| 1,990,230 | A | | 2/1935 | Gray | |
| 2,667,001 | A | | 1/1954 | Sheridan | |
| 3,691,787 | A | * | 9/1972 | Kaufmann | 239/23 |
| 4,281,794 | A | * | 8/1981 | Dimino | 239/23 |
| 4,413,778 | A | * | 11/1983 | Middlemiss | 239/23 |
| D320,234 | S | | 9/1991 | Garrett | |
| 5,109,620 | A | | 5/1992 | Torrence | |
| 6,053,422 | A | | 4/2000 | Polzin et al. | |

FOREIGN PATENT DOCUMENTS

| | | |
|---|---|---|
| AU | 133645 | 5/1947 |
| DE | 423155 | 12/1925 |
| FR | 565830 | 2/1924 |
| FR | 598809 | 12/1925 |
| GB | 276922 | 9/1927 |

* cited by examiner

*Primary Examiner*—Philippe Derakshani
(74) *Attorney, Agent, or Firm*—Leagre Chandler & Millard LLP

(57) ABSTRACT

The present invention provides decorative fountains, assemblies for fountains and decorative fountain kits. An assembly for a decorative fountain includes an overflow container defining a reservoir and an outlet in fluid communication with the reservoir, a support surface defining one or more apertures and positioned over the reservoir for supporting a drinking vessel, a support conduit defining a passageway for fluid and having a first end fluidly connected to the outlet and an opposite end defining an aperture. A bottle inlet is in fluid communication with the support conduit and is configured to mate with an inlet opening defined through the base of the beverage container so that the aperture is in fluid communication with the vessel. A pump is disposed within the reservoir and is operable to pump fluid from the reservoir through the passageway and into the vessel.

31 Claims, 18 Drawing Sheets

DECORATIVE FOUNTAIN

This Application is a continuation-in-part of U.S. application Ser. No. 29/160,953 filed May 20, 2002.

FIELD OF THE INVENTION

This Application relates generally to the field of decorative fountains and more specifically to fountains that create the illusion of an unlimited supply of a beverage being poured from a container into a drinking vessel.

BACKGROUND

For many years, there has been an interest in fountains that simulate a beverage pouring into a drinking vessel and other novelty fountains. Such fountains seek to create the illusion that a beverage container of limited size is continually dispensing beverage into a drinking vessel while hiding the pump mechanics. One drawback of many of these fountains is that while they are entertaining, they are adapted to particular containers and vessels. A need has remained for a fountain that allows convenient replacement of the containers and drinking vessels to achieve different novelty looks.

SUMMARY OF THE DISCLOSURE

The present invention provides decorative fountains, assemblies for fountains and decorative fountain kits. The fountains can be used with bottles of differing sizes and corresponding glasses to create a desired look that can be changed at the whim of the user. Certain aspects of the invention are summarized herein, however this Summary is not to be used to limit the scope of the invention.

Briefly describing one aspect of the invention, an assembly for a decorative fountain is provided. The assembly includes an overflow container defining a reservoir and an outlet in fluid communication with the reservoir. A support surface, which defines one or more apertures, is positioned over the reservoir for supporting a drinking vessel. A support conduit defines a passageway for fluid and has a first end fluidly connected to the outlet and an opposite end defining an aperture. The passageway is in fluid communication with the outlet and the aperture. A bottle inlet is in fluid communication with the support conduit and is configured to mate with an inlet opening defined through the base of the beverage container so that the aperture is in fluid communication with the vessel. A pump is disposed within the reservoir and is operable to pump fluid from the reservoir through the outlet, the passageway and the bottle inlet and into the vessel. A telescoping frame member projects from the support conduit.

In one embodiment, the support conduit includes a support base portion adjacent the first end to support the assembly on a surface. A foot member may be perpendicularly connected to the base portion. The support conduit also includes a vertical portion rising from a turn adjacent the support base portion and the opposite end is turned to position the aperture above the overflow container and in line with the support surface.

The frame is positioned to hold the beverage container angled downwardly in a pouring position with a mouth of the beverage container disposed so that a stream of fluid flowing from the beverage container will fall into the drinking vessel when the drinking vessel is sitting on the support surface. In one embodiment, the frame member includes an inner member slidably supported within an outer member and a securing element for holding the inner and outer members in an adjustable relation to accommodate bottles of differing lengths. In certain embodiments, the securing element for the inner and outer members is a thumbscrew.

A bottle catch member is attached to one of the inner and outer members and configured to rest against a portion of the beverage container in some embodiments. A bottle seat member can be attached to the one of the inner and outer members between the bottle catch member and the support conduit and is positioned to hug a portion of the vessel portion of the beverage container.

In some embodiments, the second container is bottle shaped having a reduced neck portion terminating at a mouth and a shoulder portion between the vessel portion and the neck portion and the bottle securing member is a pair of prongs sized to straddle the neck with the shoulder portion of the second container resting against the prongs. In some embodiments, the inner member terminates with the bottle catch member. The outer member may be connected to the support conduit and the bottle seat member may be attached to the outer member.

In still other embodiments, the bottle inlet has a cross-sectional dimension larger than a dimension of the inlet opening and is composed of a flexible material compressible for placement through the opening of the bottle and resilient to return towards an uncompressed state to establish a frictional relationship between the inlet opening and the bottle inlet to form a fluid tight seal. In certain embodiments, the material of the bottle inlet is transparent.

The present invention also includes fountains employing the assemblies of this invention. The fountains include a first container resembling a drinking vessel and a second container resembling a beverage container. The second container has a base connected to a sidewall forming a vessel portion defining a hollow vessel. An inlet opening is defined through the base of the second container.

The present invention also provides decorative fountain kits. The kits include an assembly of this invention, a set of first containers each resembling a different drinking vessel and a set of second containers each resembling a beverage container corresponding in appearance to one of said first containers. The set of first containers may include drinking vessels resembling at least one of a martini glass, a wineglass, an apertif glass, a brandy glass and a beer glass. The set of second containers may include beverage containers resembling at least one of a liquor bottle, a wine bottle, a liquor bottle, a brandy bottle, a beer bottle, a soda can and a beer can.

Figure 1:
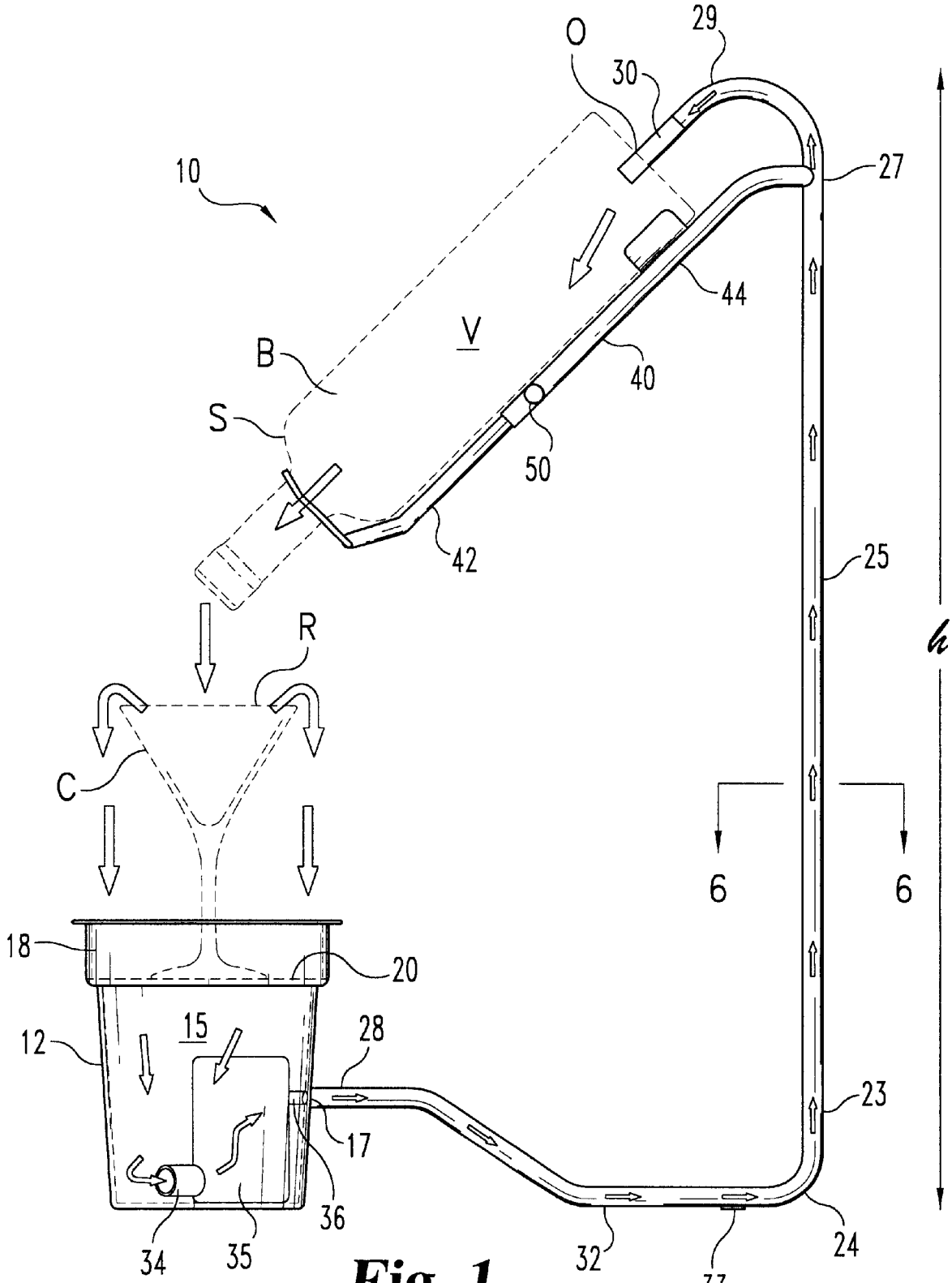
FIG. 1 is a side partial sectional view of a Fountain Assembly according to one embodiment of this invention.

Although the drawings represent embodiments of the present invention, the drawings are not necessarily to scale and certain features may be exaggerated in order to better illustrate and explain the present invention. The exemplification set out herein illustrates certain embodiments of the invention, in one, or more forms, and such exemplifications are not to be construed as limiting the scope of the invention in any manner.

DESCRIPTION OF THE PREFERRED EMBODIMENTS

For the purposes of promoting an understanding of the principles of the invention, reference will now be made to the embodiments illustrated in the drawings and specific language will be used to describe the same. It will nevertheless be understood that no limitation of the scope of the invention is thereby intended. The invention includes any alterations and further modifications in the illustrated devices and described methods and further applications of the principles of the invention that would normally occur to one skilled in the art to which the invention relates.

The present invention provides continuous fountains, assemblies for creating fountains and fountain kits. The fountains of the present invention create the illusion that a beverage container has a perpetual supply of fluid, which continually pours into a drinking vessel. The fountains, assemblies and kits of this invention have a support member that allows the user to change the beverage container and drinking vessel to create different novelty fountains at the user's whim.

Figure 4:
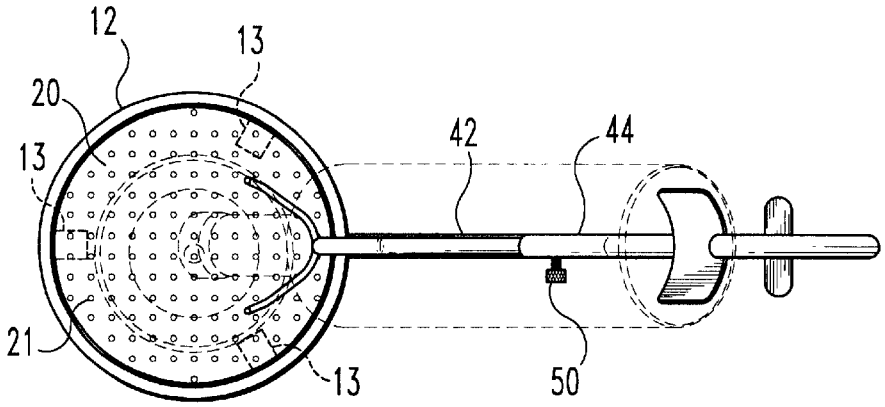
FIG. 4 is a bottom and rear perspective view of the embodiment shown in FIG. 1.
Figure 5:
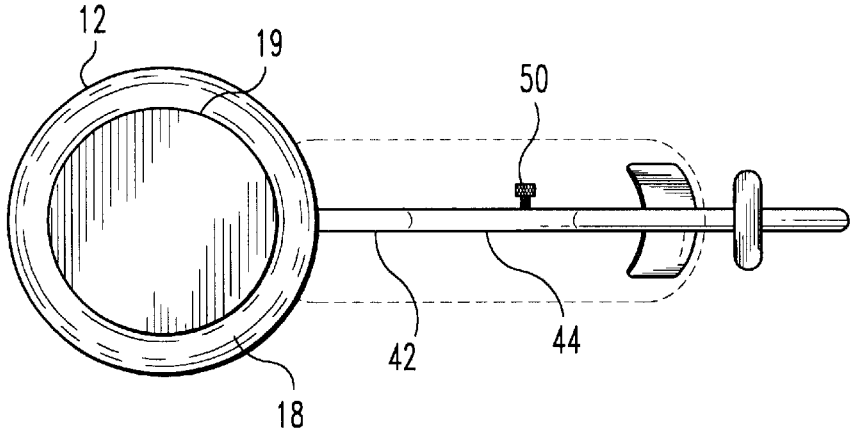
FIG. 5 is a top and front perspective view of the embodiment shown in FIG. 1.
Figure 6:
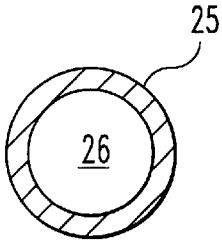
FIG. 6 is a cross-section of the embodiment shown in FIG. 1 taken along lines 6—6.

In one embodiment, the invention provides an assembly 10 for use with a drinking vessel C and a beverage container B to form a continuous fountain as shown in FIGS. 1–8. Assembly 10 includes an overflow container 12 defining a reservoir 15 and an outlet 17 in fluid communication with the reservoir 15. A support surface 20 is positioned over the reservoir 15 for supporting the drinking vessel C. The support surface 20 defines an aperture 21 for communicating fluid that spills over the rim R of the drinking vessel C into the reservoir 15. In one embodiment, support surface 20 has numerous apertures 21 as shown in FIG. 4. In still another embodiment, the support surface 20 includes a screen made of wire mesh.

In one particular embodiment, support surface 20 is supported above reservoir 15 by inwardly projecting tabs 13. The invention contemplates any number and size of tabs 13 that will support drinking vessel C when it is filled with fluid during operation of assembly 10. In still another embodiment, support surface 20 rests on a ledge 14 positioned along the perimeter of an inner surface 16 of a sidewall 11 defining the reservoir 15. In this particular embodiment shown more clearly in FIG. 8, container 12 includes an enlarged upper portion 18 above the reservoir 15 joined at a step-out portion 19. The step-out portion 19 forms a ledge 14 for the support surface 20.

Figure 7:
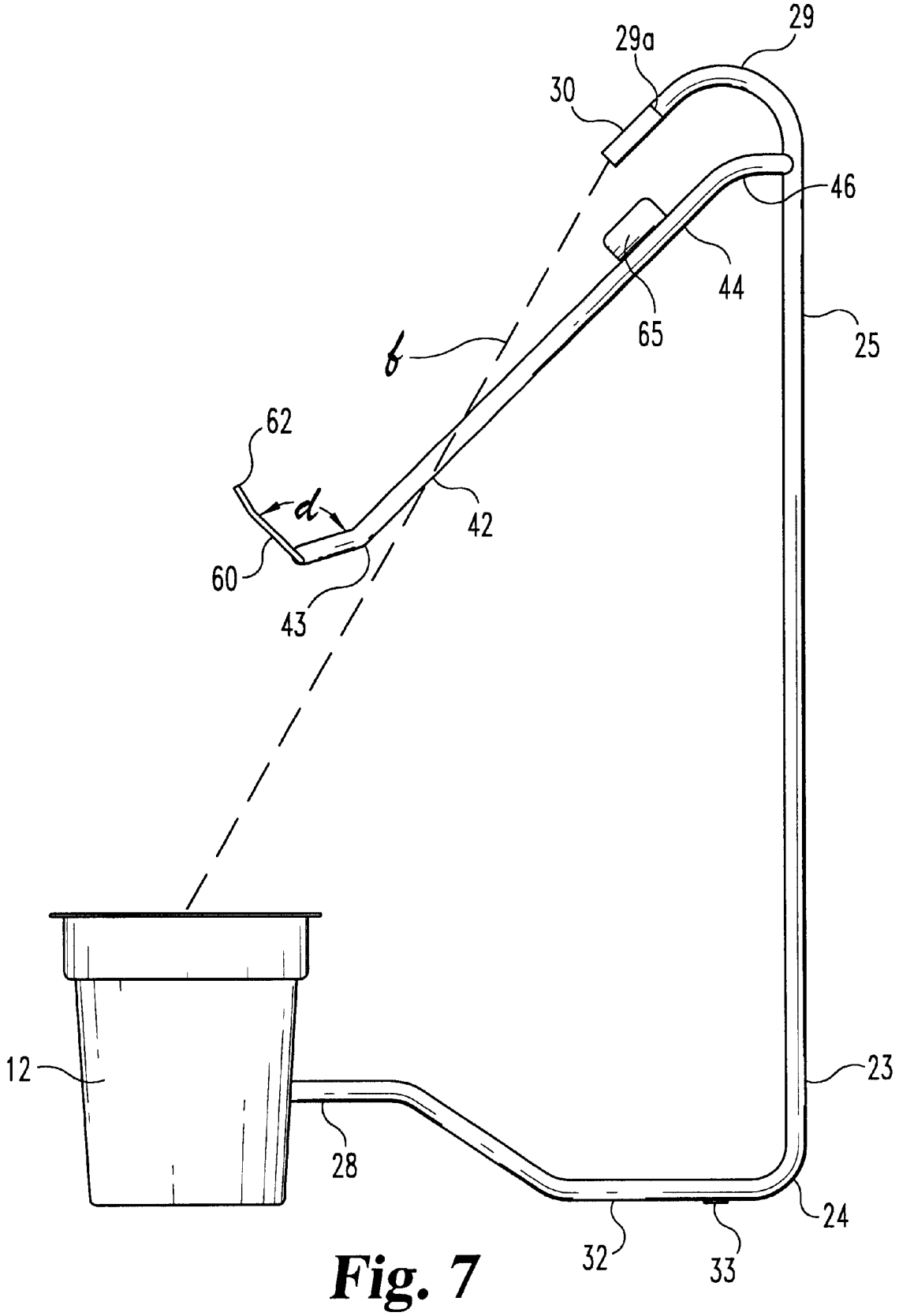
FIG. 7 is a side elevational view of the fountain assembly of FIG. 1.
Figure 8:
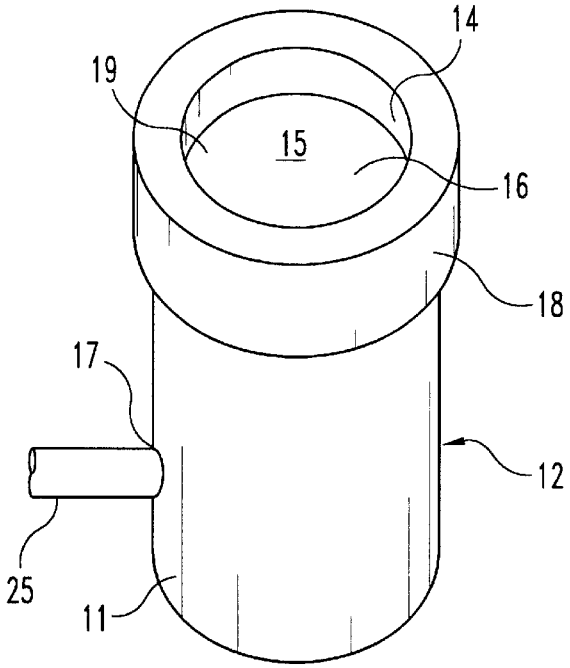
FIG. 8 is a partial top perspective view of the embodiment of FIG. 1.

Assembly 10 further includes a support conduit 25 defining a passageway 26 (FIG. 6) for transporting fluid from the reservoir 15 to the beverage container B. Referring now to FIG. 7, a first end 28 of support conduit 25 is fluidly connected through a first opening (not shown) to the outlet 17, and the opposite end 29 defines a second opening 29*a*. Passageway 26 is in fluid communication with outlet 17 and the second aperture 29*a*.

In a specific embodiment, support conduit 25 includes a support base portion 32 adjacent the first end 28 of the support conduit. Support base portion 32 is configured, together with the overflow container 12, to support the assembly 10 on a surface, such as the top of a table or a bar. In this specific embodiment, a foot member 33 is perpendicularly connected to the base portion 32 to provide additional support to assembly 10.

Support conduit 25 further includes a vertical portion 23 rising from a turn 24 adjacent the support base portion 32. In addition, the opposite end 29 is turned to position the second opening 29*a* above the overflow container 12 and in line with the support surface 20 as shown by the dotted line f in FIG. 7.

A bottle inlet 30 is in fluid communication with the second opening 29*a* defined in the opposite end 29 of support conduit 25 and is configured to mate with an inlet opening O defined through the base b of the beverage container B so that passageway 26 is in fluid communication with vessel V of bottle B. In a specific embodiment, bottle inlet 30 is composed of a flexible material and has a cross-sectional dimension larger than a dimension of the inlet opening. The flexible material is compressible for placement through the opening of the bottle and resilient to return towards an uncompressed state to establish a frictional relationship between the inlet is opening O and the bottle inlet 30 to form a fluid tight seal. In one specific embodiment, the material of the bottle inlet is transparent to camouflage the bottle inlet 30 within the drinking container B.

Referring again to FIG. 1, a pump 35 is disposed within reservoir 15 and is operable to pump fluid from reservoir 15 into a pump inlet 34, through pump outlet 36, outlet 17, passageway 26 and the bottle inlet 30 and into vessel V. The circulation of fluid through assembly 10 is shown in FIG. 1 by the arrows. Outlet 17 of the container 12 is sized and positioned to mate with fluid outlet 36 of the pump. Any suitable pump is contemplated. Such pumps are available in retail aquarium and landscaping stores. In one embodiment, the pump is battery operated so that it is not necessary to use a cord. In another embodiment, the pump is electrical, and the container 12 and support surface 20 each define a cord groove 22 for the electrical cord 37. As most clearly seen in FIGS. 9 and 10 the cord groove 22 can be located above the outlet 17 so that the cord 37 will be unobtrusive during the operation of the fountain.

It will be understood that the pump will be selected in combination with factors such as the height h of the vertical portion 24, and the overall length L of the support conduit 25 and the viscosity of the circulating fluid. Moreover, the number and dimensions of apertures 21 are selected to provide optimum fluid flow from support surface 20 to reservoir 15 taking into consideration other features of the fountain assembly 10, such as the overall length L of the support conduit 25, which can be calculated by adding the lengths of first end 28, a transition position 31, support base portion 32, turn 24, vertical portion 23 and opposite end 29, each having lengths, $l_1$, $l_2$, $l_b$, h and $l_0$, respectively. (See FIG. 2.) Thus, the overall length L can be calculated using the following formula: $L=l_1+l_2+l_b+h+l_0$. For example, in one specific embodiment, the support conduit had an overall length L of 60 inches (150 cm) with a vertical height h of 24 inches (60 cm) and the pump was a Mini-Jet 606, which has an adjustable flow rate of up to about 100 gallons per hour. The pump speed was adjusted to achieve an appropriate flow rate. In general, the flow rate is too fast if the fluid is pumped into the bottle faster than it can empty and/or if splashing occurs. The flow rate is too slow if the fluid flow from the mouth of the bottle stops or drips. Of course, any suitable pump is contemplated.

Referring again to FIGS. 1 and 4, assembly 10 also includes a telescoping frame member 40 projecting from support conduit 25. The telescoping feature allows the assembly to be combined with bottles of differing lengths so that the user may select bottles that represent a particular novelty look. For example, the assembly may be used with a liquor bottle, which may be then easily and conveniently replaced with a beer bottle.

Figure 11:
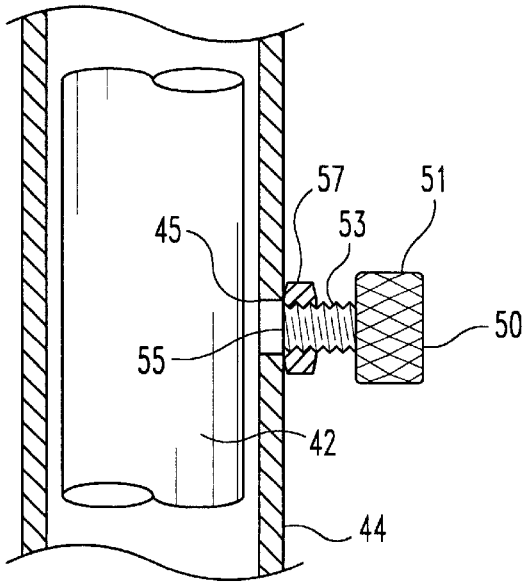
FIG. 11 is a partial sectional view of the frame member of the embodiment of FIG. 1.

In one particular embodiment, frame member 40 includes an inner member 42 that is slidably supported within an outer member 44. In a specific embodiment, outer member 44 is connected to support conduit 25 at a location 27 adjacent the opposite end 29. A securing element for holding the inner and outer members in an adjustable relation to accommodate bottles of differing lengths is provided. In a particular embodiment, the securing element is a thumbscrew 50. Referring now to FIG. 11, thumbscrew 50 is shown in a released position wherein inner member 42 can be moved relative outer member 44 to lengthen or shorten frame 40. In this particular embodiment, thumbscrew 50 has a knurled handle portion 51, a threaded shank 53 and a flat tip 55. A threaded nut is secured to outer member 44 surrounding a screw hole 45 defined through the outer member 44. To secure the inner and outer members 42, 44 in position, thumbscrew 50 is turned so that screw threads 53 engage threads in the nut 57 and the tip 55 of the thumbscrew bears against inner member 42.

Figure 2:
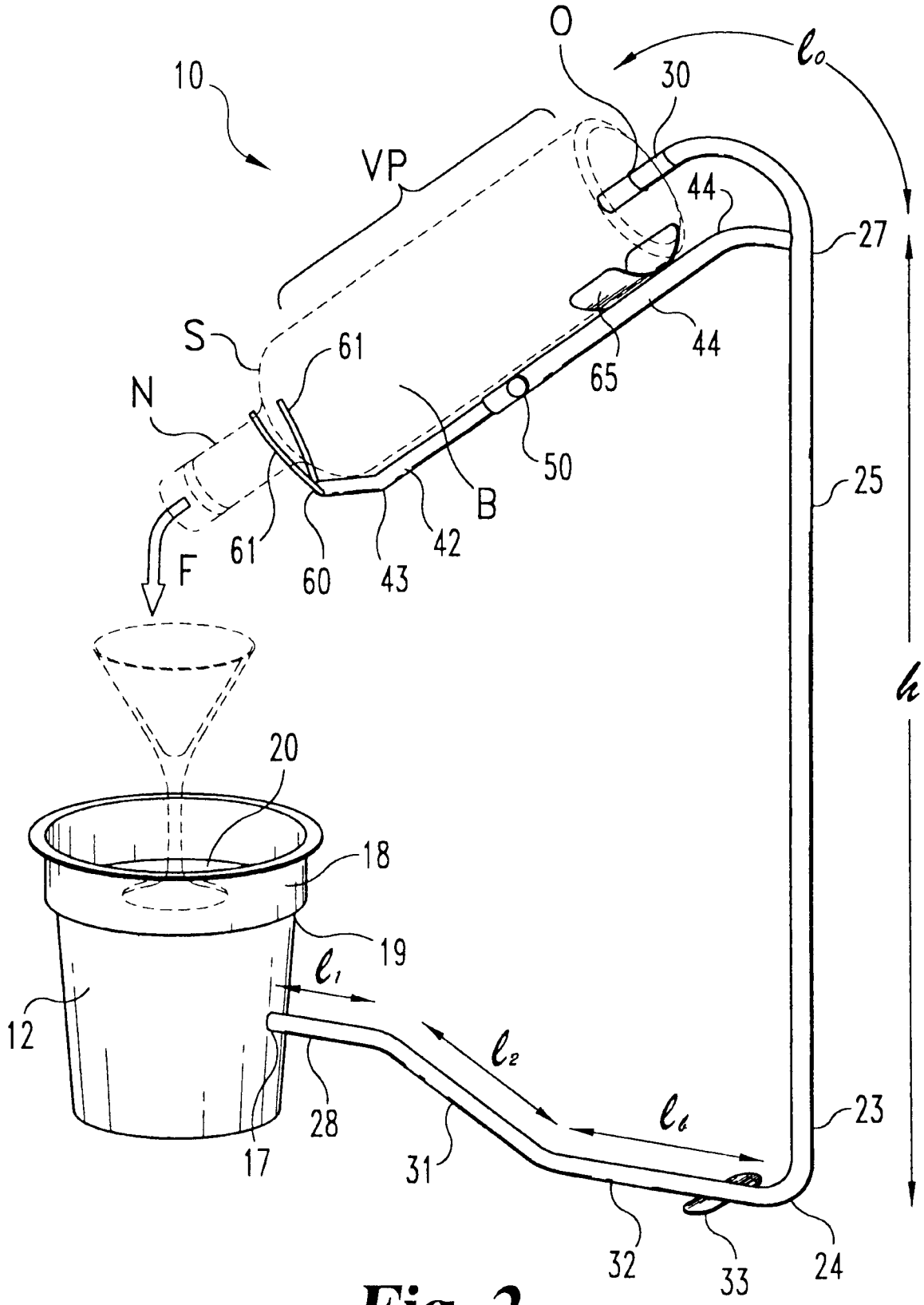
FIG. 2 is a perspective view of one side of the embodiment shown in FIG. 1.
Figure 3:
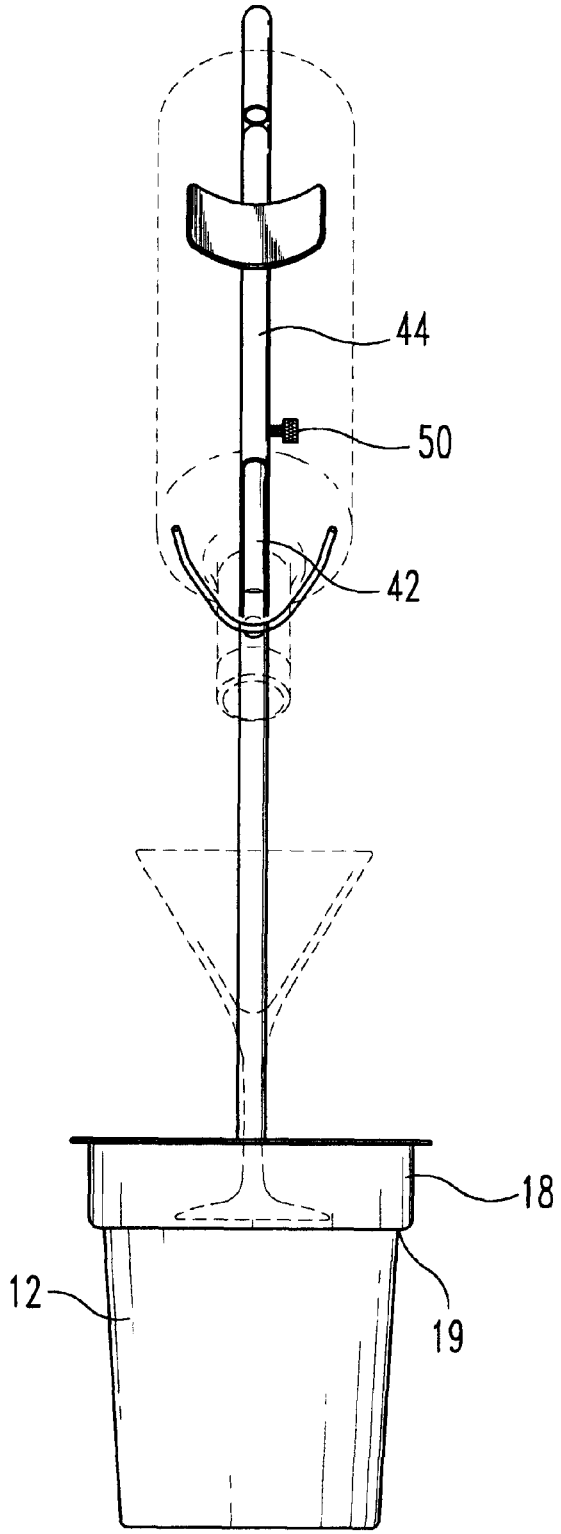
FIG. 3 is a front elevational view of the embodiment shown in FIG. 1.
Figure 9:
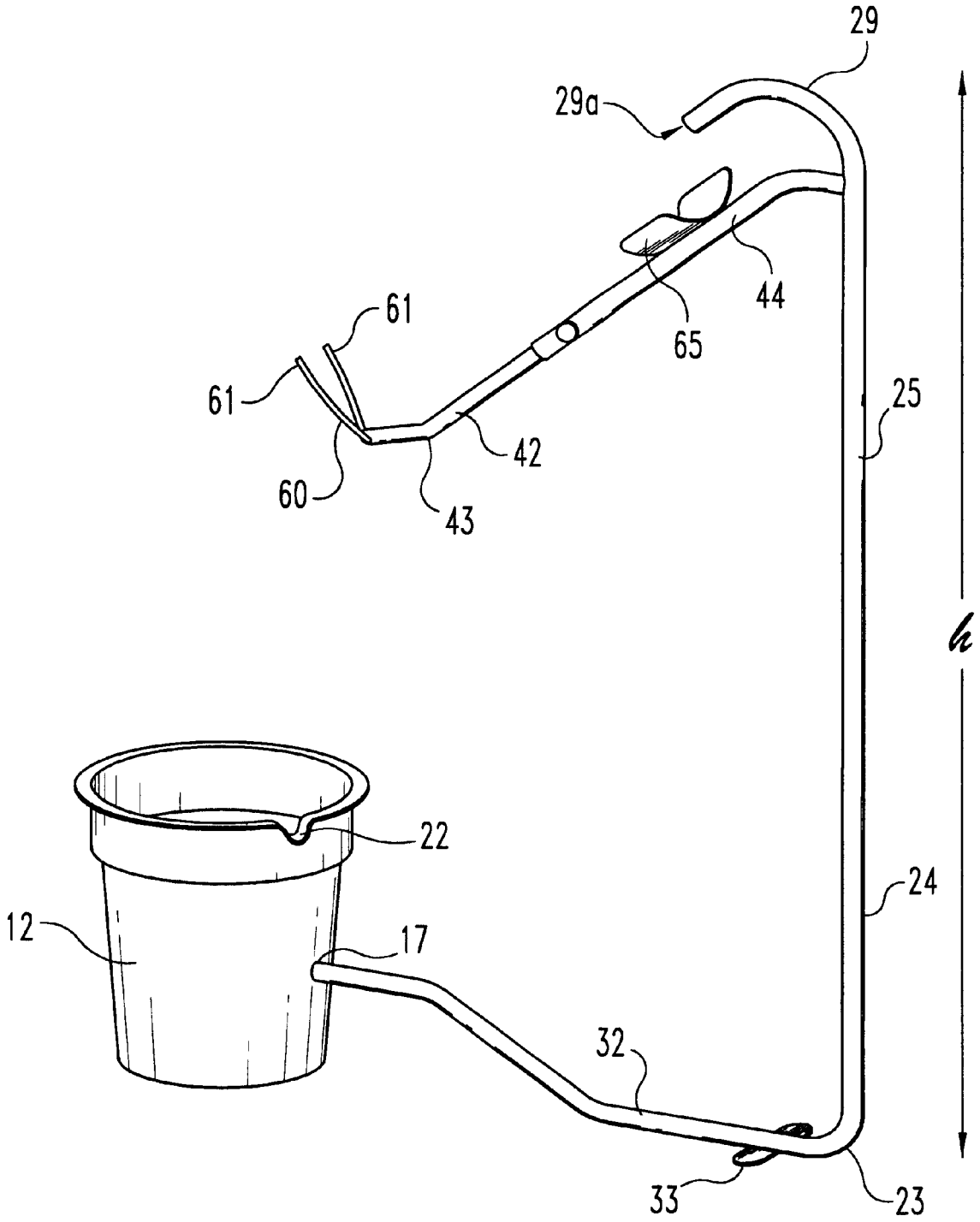
FIG. 9 is a side perspective view of components of the fountain assembly of FIG. 1.
Figure 10:
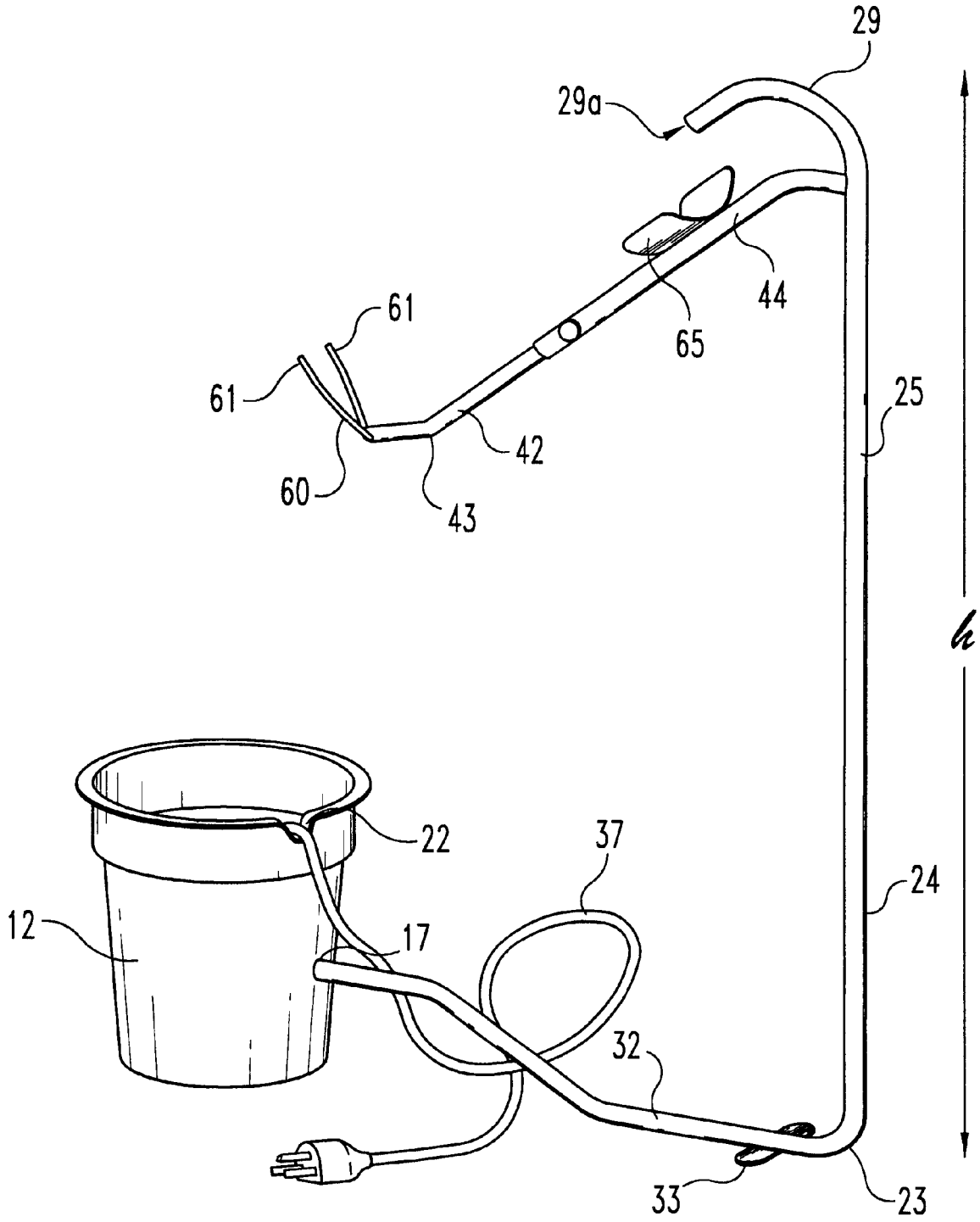
FIG. 10 is a side perspective view of components of the fountain assembly of FIG. 1.

In one particular embodiment, frame member 40 includes a bottle catch member 60 attached to one of the inner and outer members 42, 44 as shown most clearly in FIGS. 2, 7 and 9. Catch member 60 is configured to rest against a portion of a bottle B. In some embodiments, bottle catch member 60 is a pair of prongs 61 sized to straddle the neck N of the bottle B with the shoulder portion S of the bottle resting against the prongs 61. In this embodiment, inner member 42 terminates with the bottle catch member 60. In some embodiments, inner member includes a bend 43 adjacent the prongs 61, which accommodates the shoulder portion S and cradles the bottle B. The prongs 61 in FIG. 7 extend from the inner member at an angle of about 90° when inner member includes bend 43. In a specific embodiment, the ends 62 of prongs 61 are slightly curved to further cradle a bottle.

Frame member 40 also includes a bottle seat member 65 attached to the one of the inner and outer members 42, 44 between the bottle catch member 60 and the support conduit 25. Seat member 65 is positioned and shaped to hug a portion of the vessel portion VP of the bottle B. In one particular embodiment, seat member 65 is a flat, curved plate. In the embodiment shown in FIGS. 7 and 9, seat member 65 is attached to outer member 44.

Referring again to FIG. 2, frame 40 is positioned and shaped to hold a bottle B angled downwardly in a pouring position with the mouth of the bottle disposed so that a stream of fluid (shown by arrow F) flowing from the bottle will fall into the drinking vessel C when the drinking vessel C is sitting on the support surface 20. As shown in FIG. 7, frame 40 may include a curve 46, which better positions the bottle B when it is cradled by the frame member 40.

Figure 12:
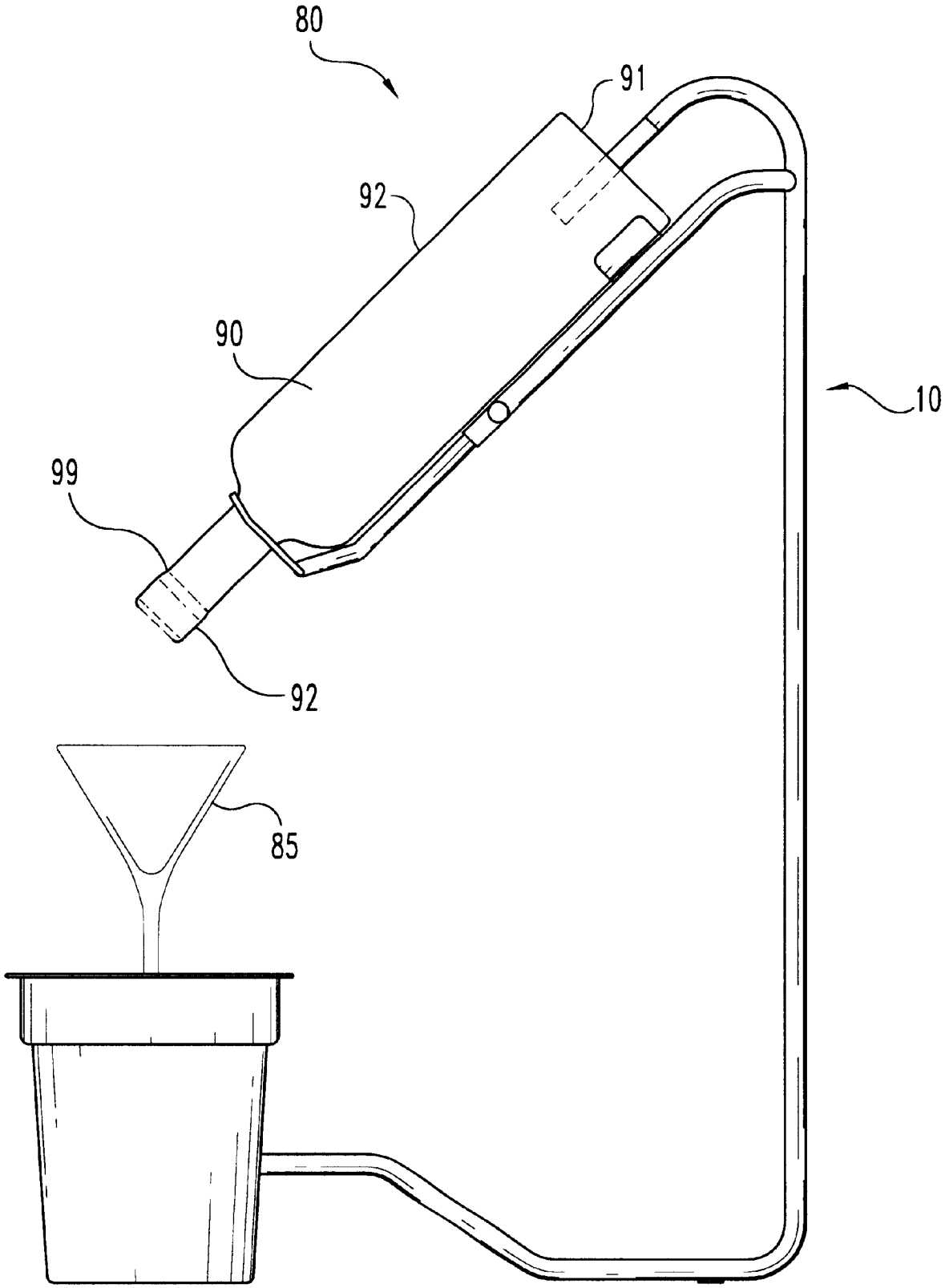
FIG. 12 is a side elevational view of a decorative fountain of this invention.
Figure 13:
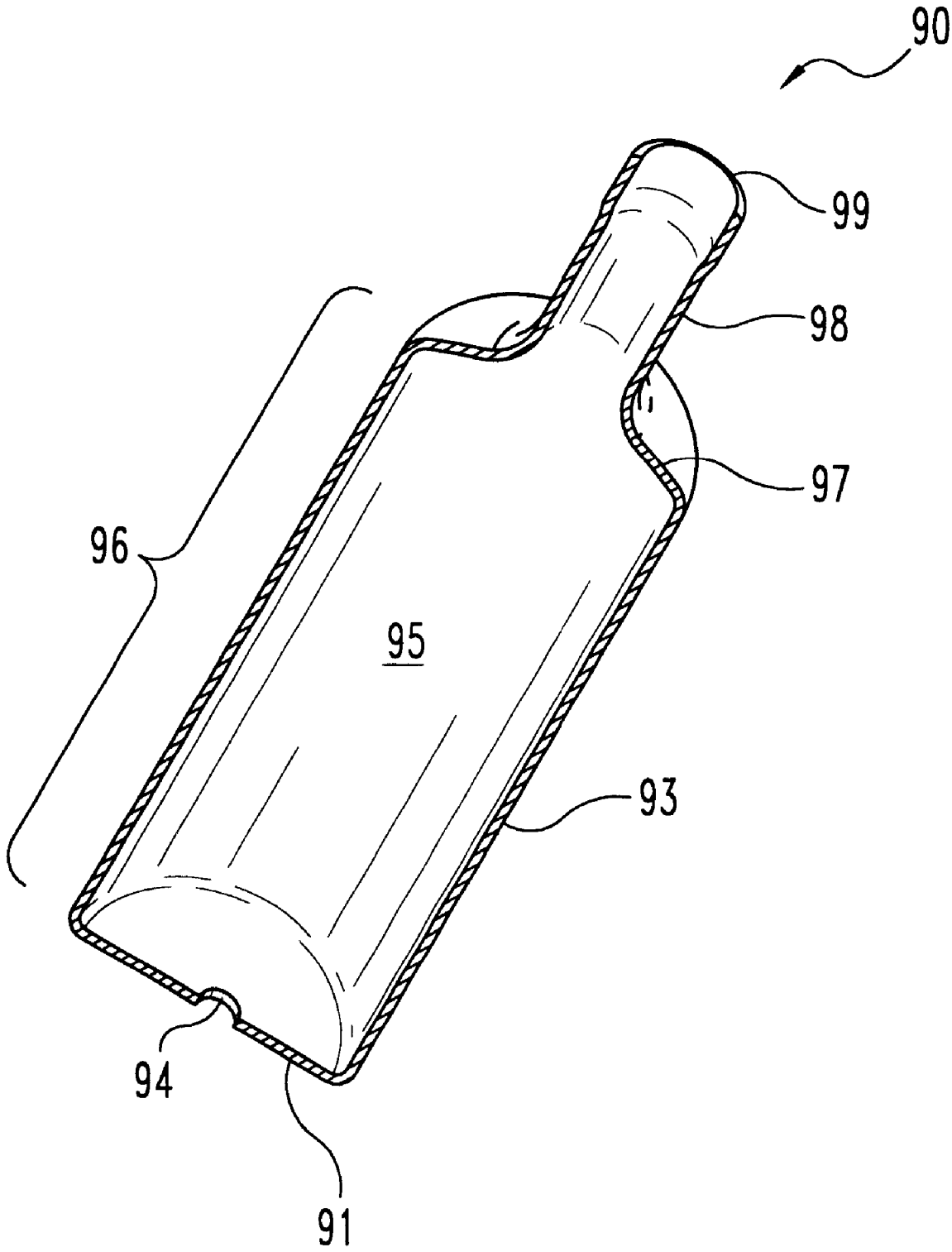
FIG. 13 is a sectional view of a bottle of this invention.
Figure 14:
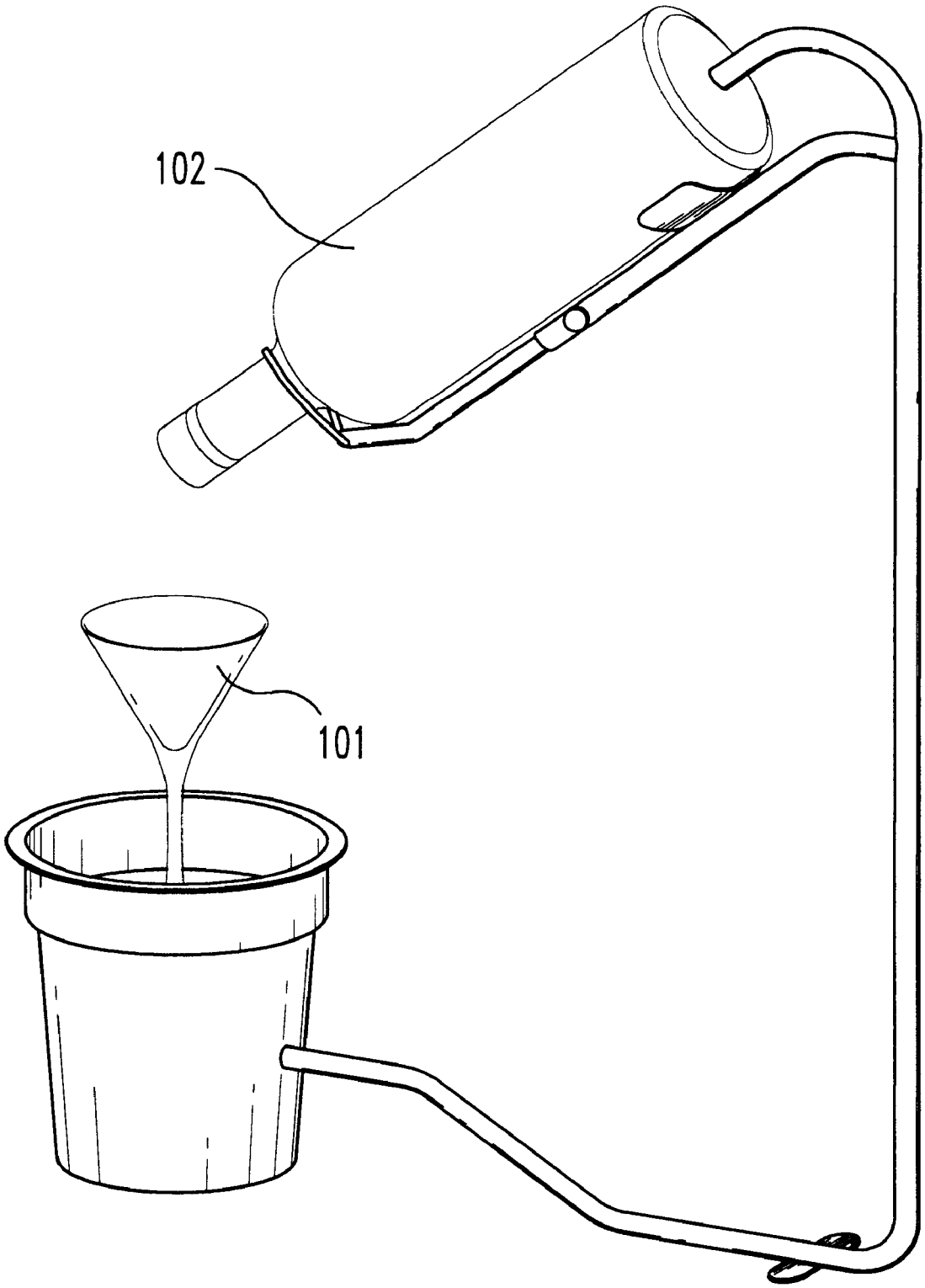
FIG. 14 is a side perspective view of a kit according to this invention set up with a martini glass and a liquor bottle.
Figure 15:
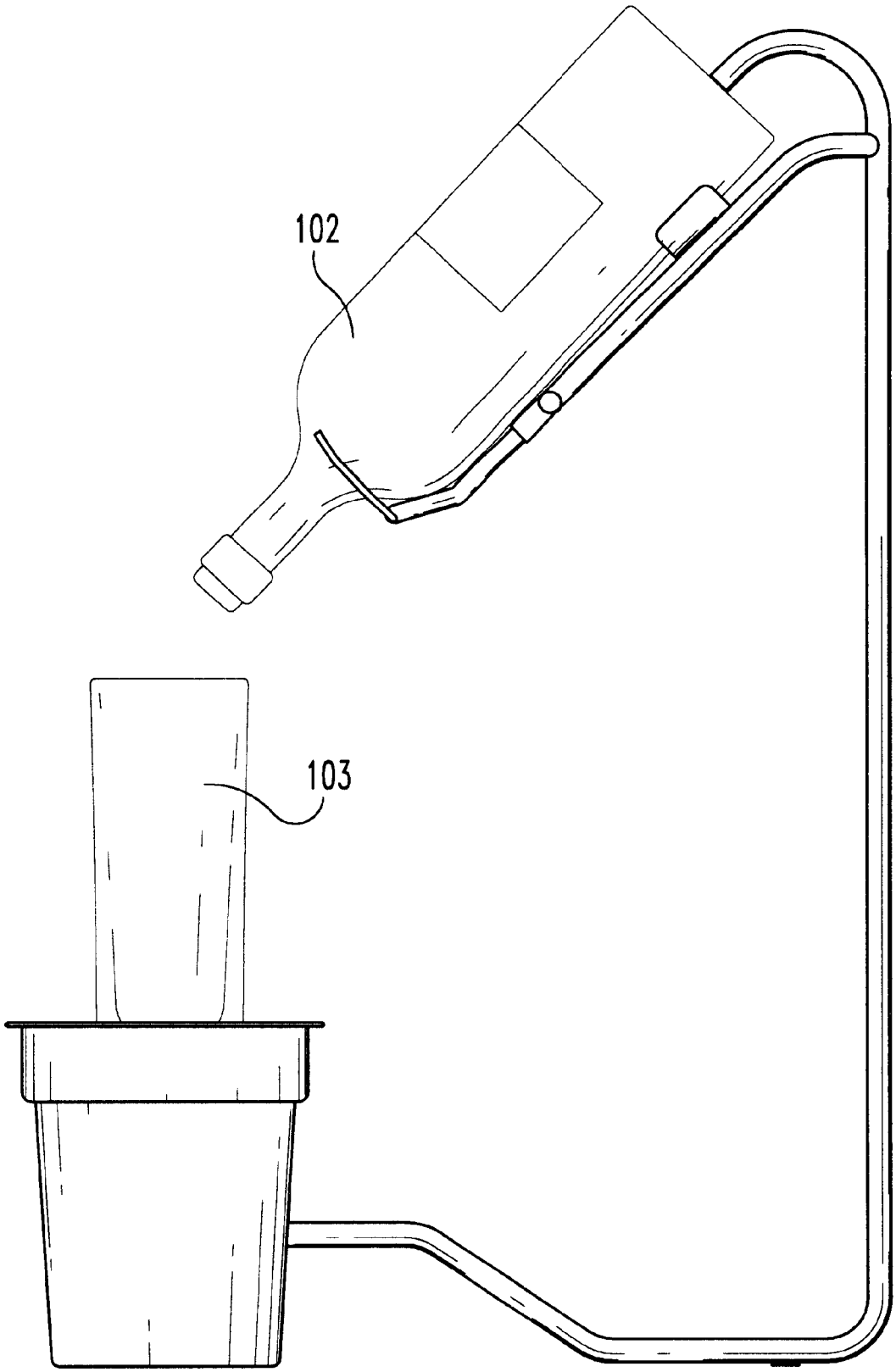
FIG. 15 is a side perspective view of the kit of FIG. 14 set up with a highball glass and a liquor bottle.
Figure 16:
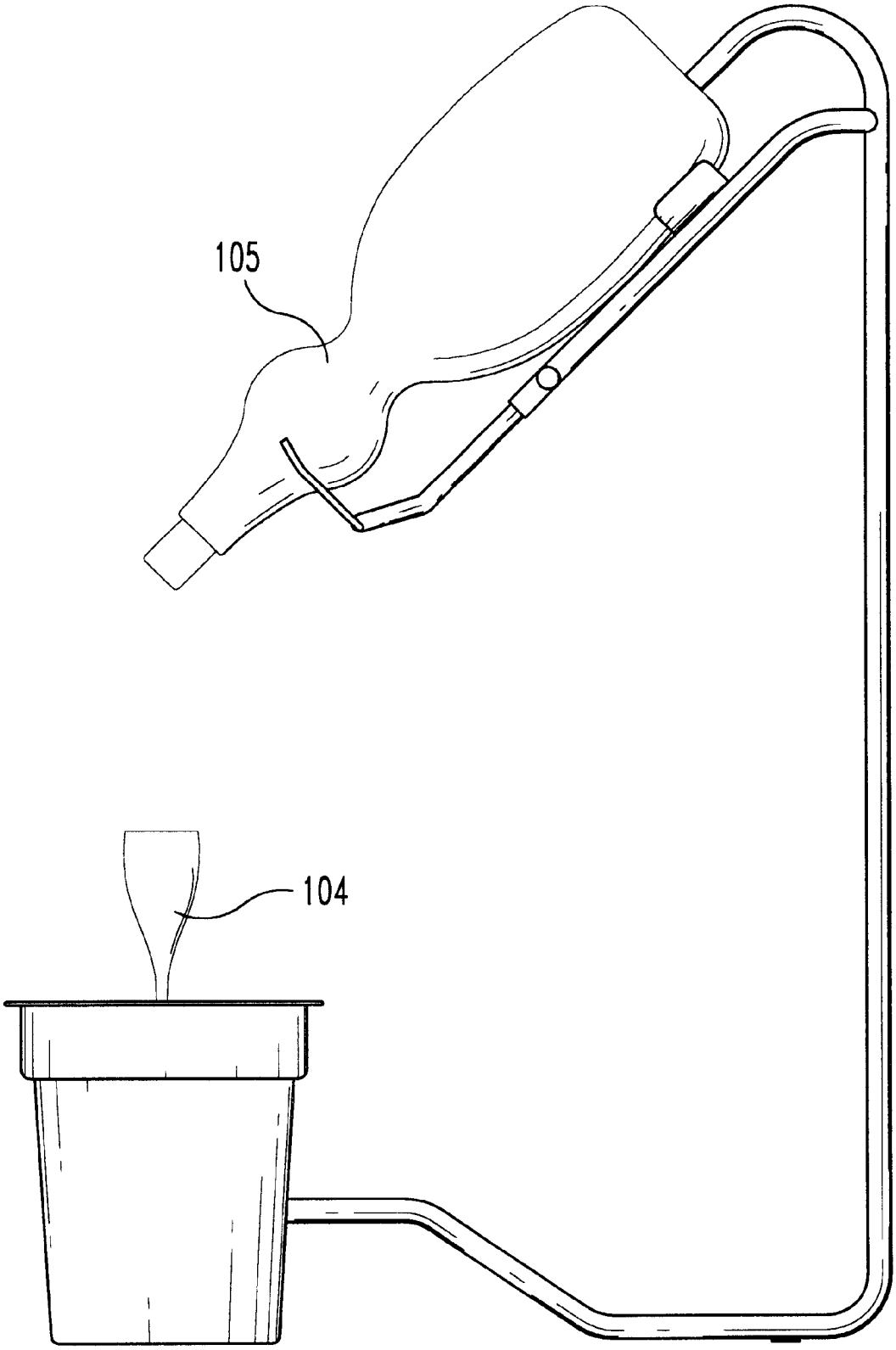
FIG. 16 is a side perspective view of the kit of FIG. 14 set up with an apertif glass and a liqeuor bottle.
Figure 17:
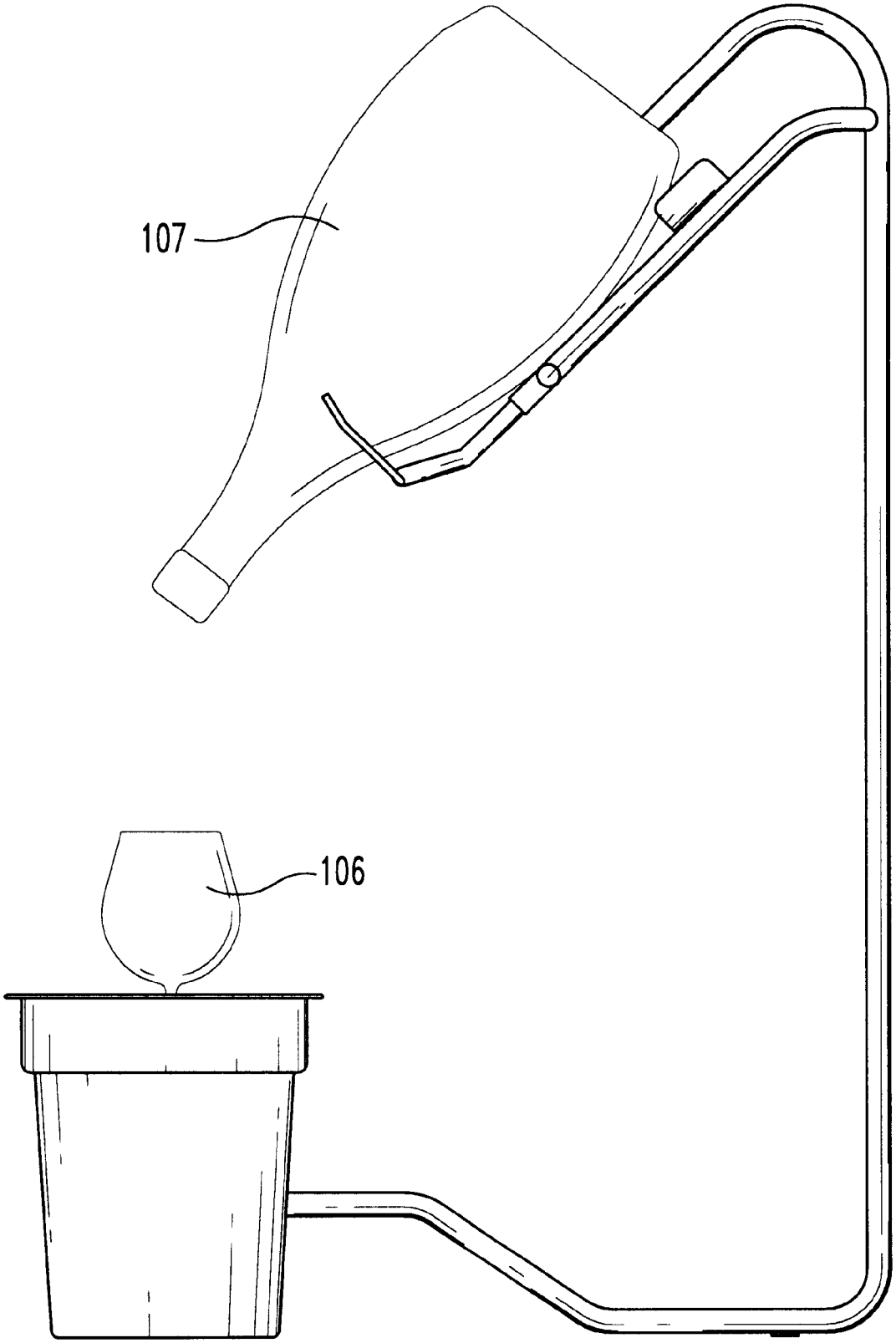
FIG. 17 is a side perspective view of the kit of FIG. 14 set up with a brandy glass and a brandy bottle.
Figure 18:
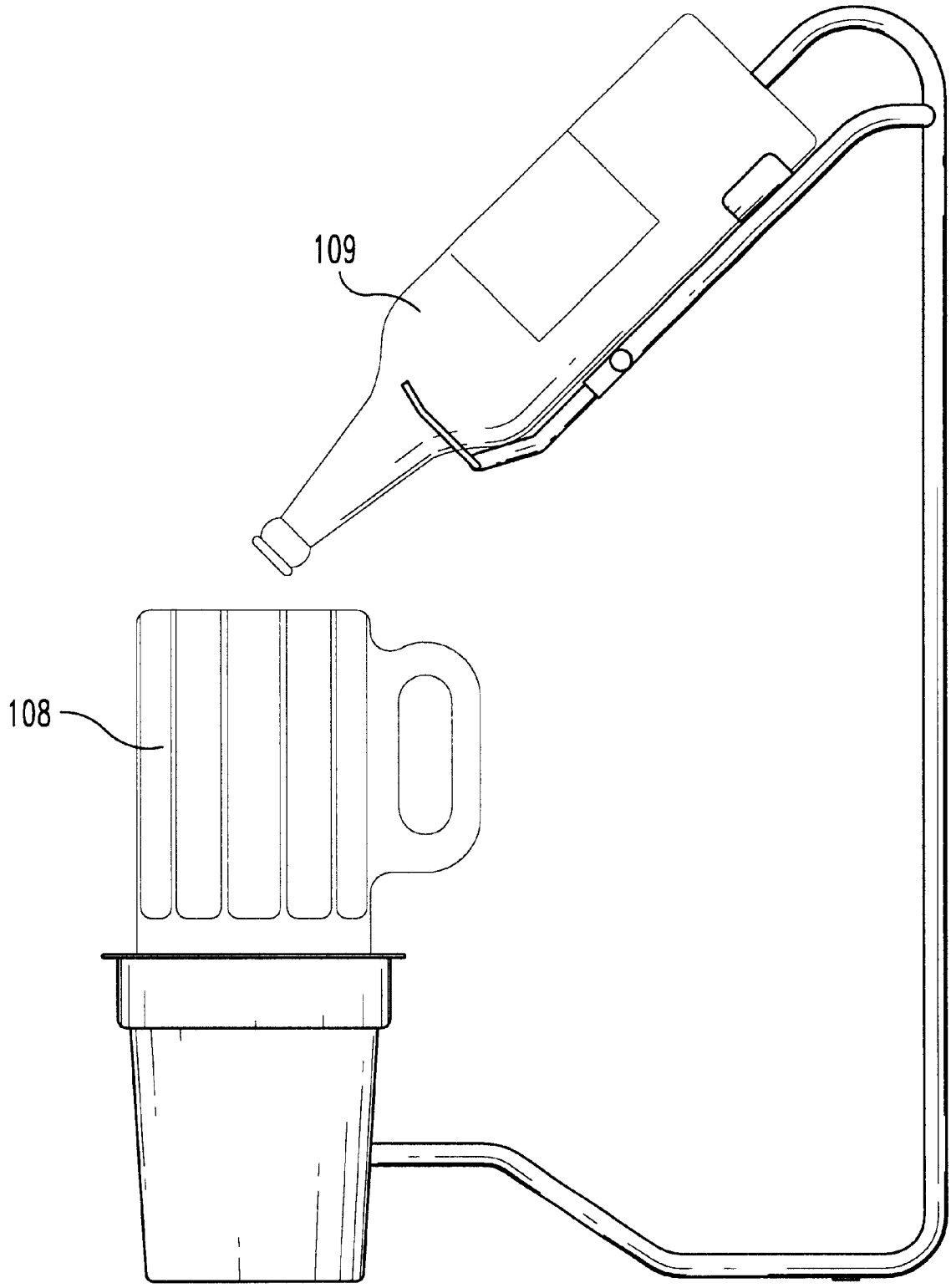
FIG. 18 is a side perspective view of the kit of FIG. 14 set up with a beer mug and a beer bottle.
Figure 19:
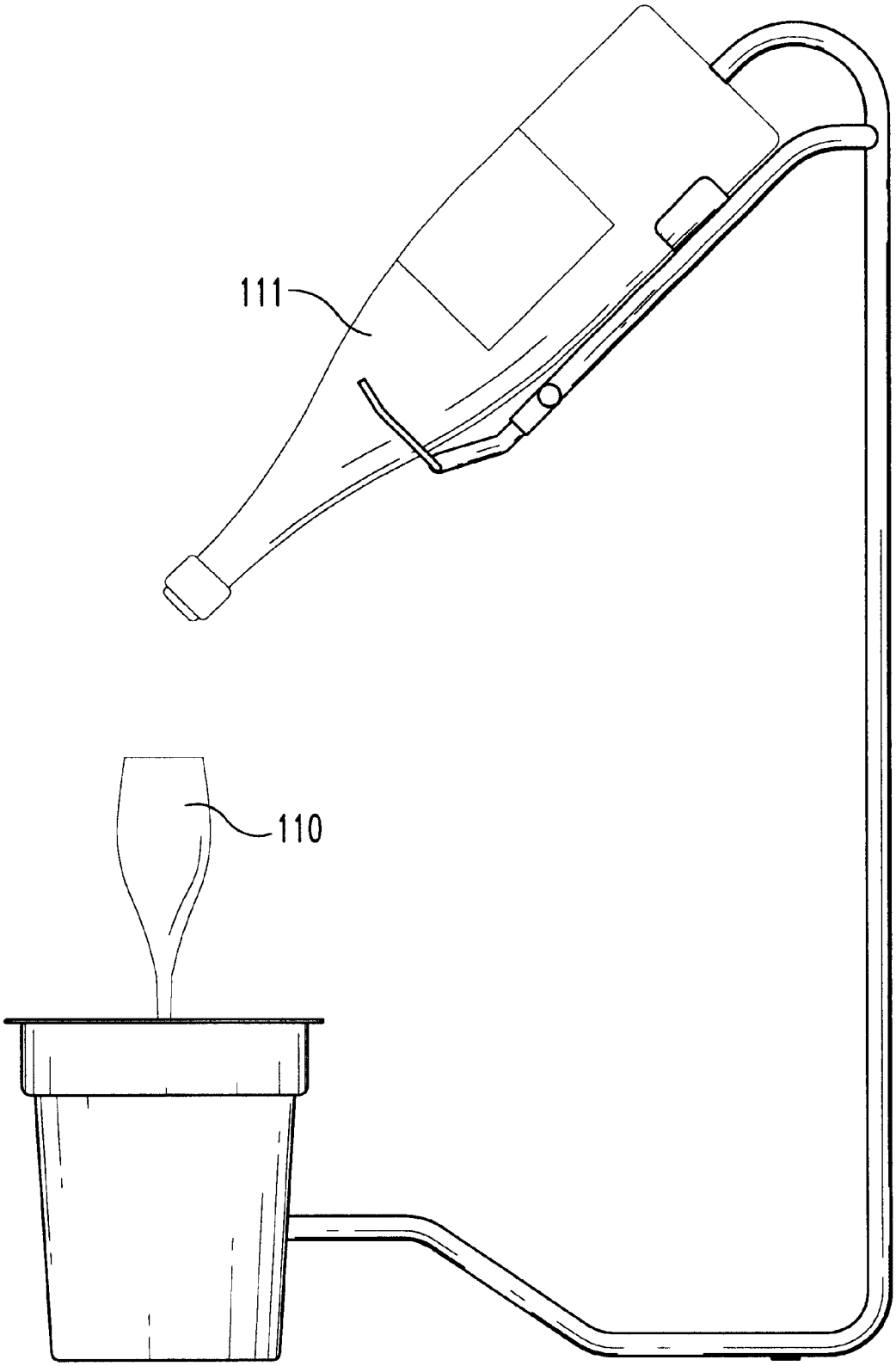
FIG. 19 is a side perspective view of the kit of FIG. 14 set up with a wineglass and a wine bottle.
Figure 20:
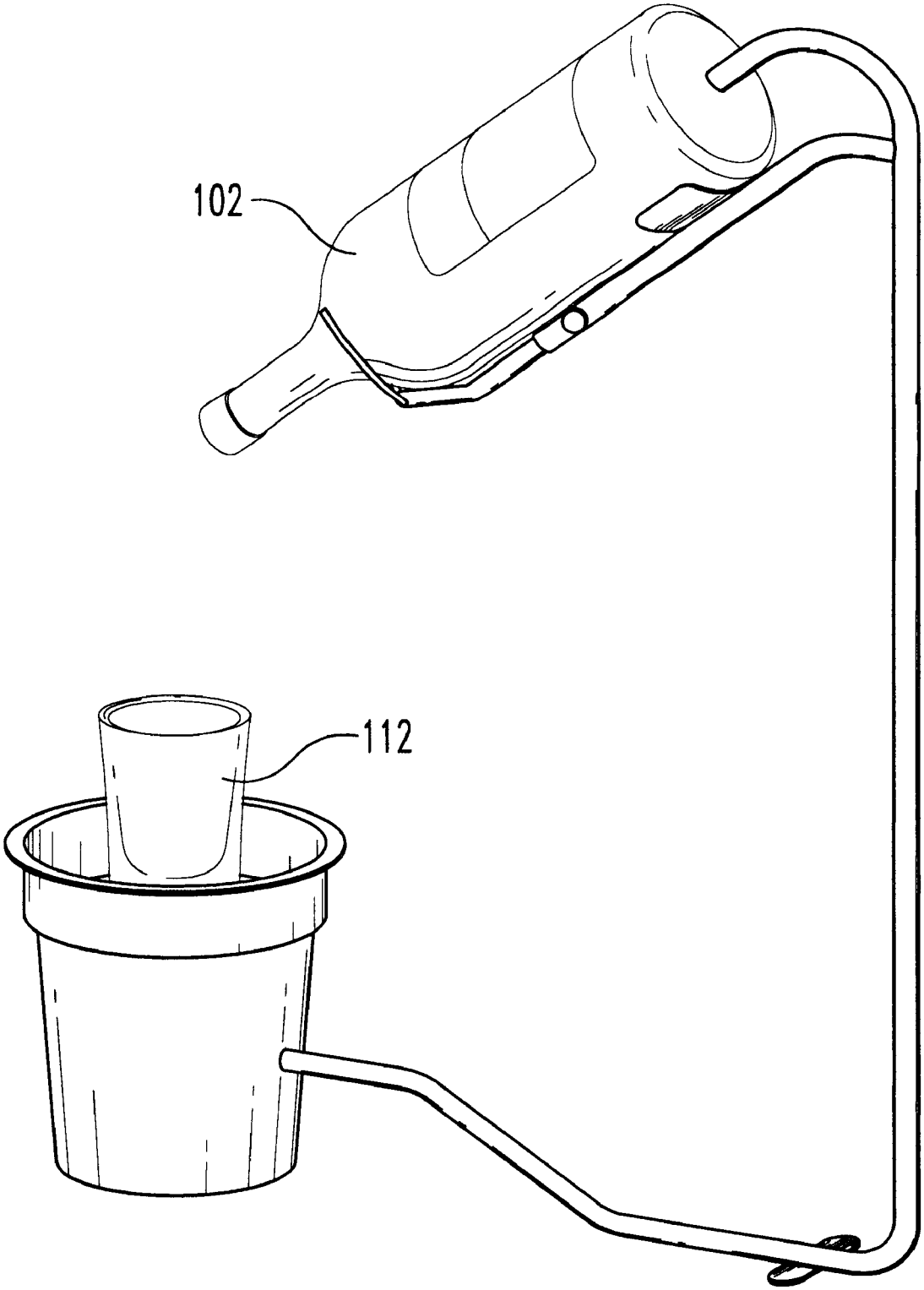
FIG. 20 is a side perspective view of the kit of FIG. 14 set up with a shot glass and a liquor bottle.

Referring now to FIGS. 12 and 13, the invention also includes a decorative fountain 80, which includes assembly 10 plus a first container 85 resembling a drinking vessel and a second container 90 resembling a beverage bottle. The first container 85 can resemble any suitable drinking vessel, such as a cup or a glass. In some embodiments, the first and second containers 85, 90 are adapted from existing glass beverage containers. For example, a bottle of a favorite brand of vodka may be adapted according to this invention and paired with a martini glass. In other embodiments, the first and second containers 85, 90 are manufactured of a transparent but unbreakable material such as plastic for safety.

Second container 90 has a base 91 connected to a sidewall 93 forming a vessel portion 96 defining a hollow vessel 95. A reduced neck portion 98 terminates at a mouth 99, and a shoulder portion 97 is located between the vessel portion 96 and the neck portion 98. Base 91 defines an inlet opening 94 therethrough. When the second container is an existing beverage bottle, the inlet opening 94 can be formed by drilling a hole through the base 91 of the bottle. For second containers specifically manufactured for this invention, the second container 90 can be molded with the hole formed in the mold or the hole can be drilled into the molded piece, for example. The particular methods of manufacturing or adapting the second container of this invention are not critical so long as the second container is suitable.

As shown in FIG. 12, a bottle cap 92 may be attached to the mouth 99 of the bottle 90. Cap 92 has a hole drilled therethrough to provide an opening for the fluid. Cap 92 provides a decorative function and also allows flow adjustment. The size of the hole in the cap 92 can be adjusted to achieve a desired flow rate taking into consideration the other features of this invention, such as the overall length L.

The invention also provides a decorative fountain kit, which includes an assembly 10 of this invention, a set of first containers each resembling a different beverage vessel and a set of second containers each resembling a beverage bottle corresponding in appearance to one of the first containers as shown in FIGS. 14–20. The set of first containers may include beverage vessels resembling at least one of a martini glass 101, a highball glass 103, an apertif glass 104, a brandy glass 106, a mug 109, a wineglass 110 and a shot glass 112, for example. The set of second containers may include corresponding containers resembling at least one of a liquor bottle 102, a liqeuor bottle 105, a brandy bottle 107, a beer bottle 109 and a wine bottle 111, for example.

The fountain may be used with any suitable fluid. In some embodiment, the fluid is water, which may be dyed to resemble a particular beverage. In other embodiments, the particular beverage that corresponds to the bottle and beverage vessel may be circulated throughout the fountain. If the actual beverage is used, care should be taken to use a suitable pump and to clean the fountain components. Moreover, the beverage will most likely need to be periodically replenished.

Figure 21:
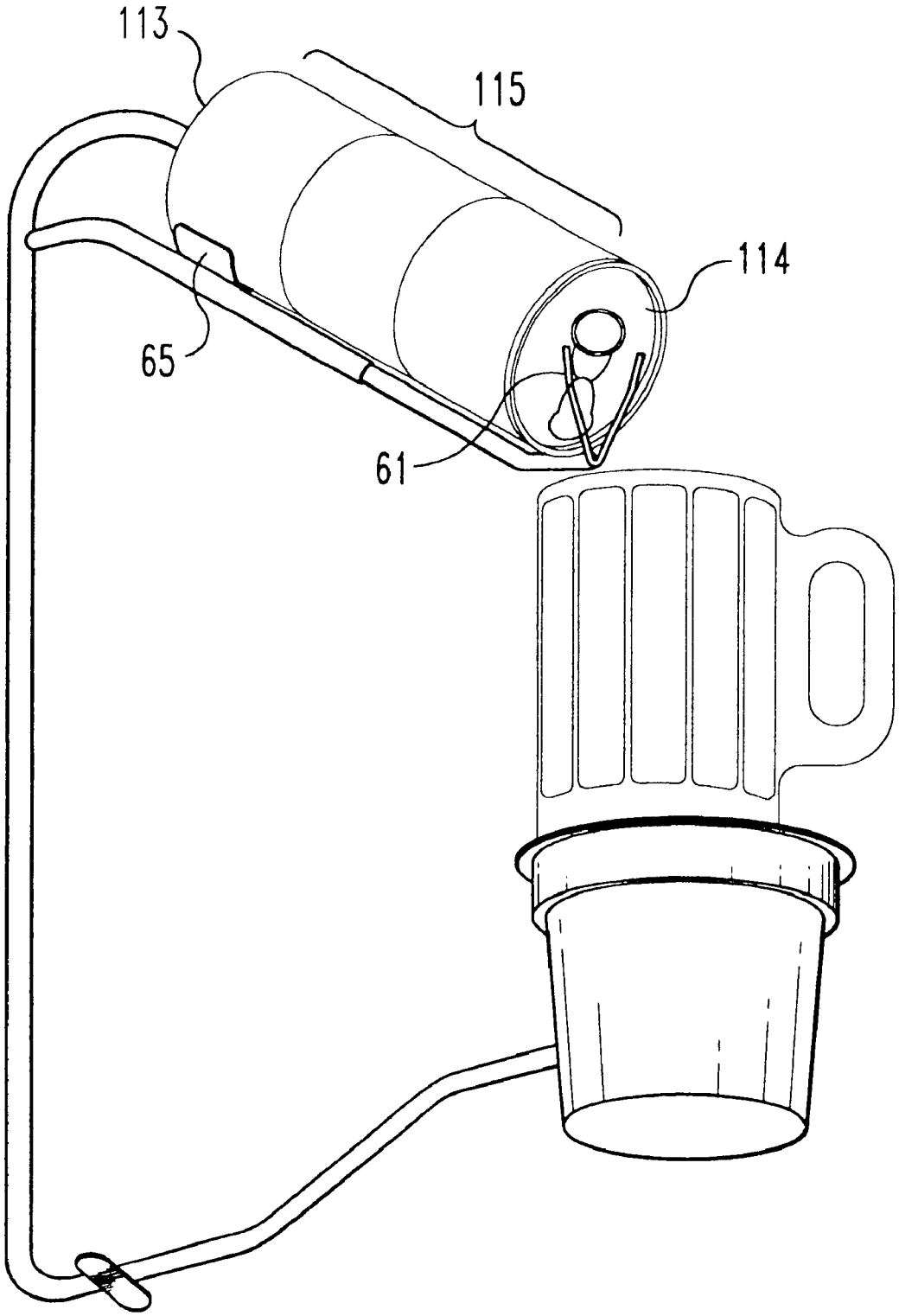
FIG. 21 is a side perspective view of the kit of FIG. 14 set up with a beer mug and a beer can.

While the invention has been illustrated and described in detail in the drawings and foregoing description, the same is to be considered as illustrative and not restrictive in character. It should be understood that only the preferred embodiments have been shown and described and that all changes and modifications that come within the spirit of the invention are desired to be protected. Because of the adjustable function of the fountains of this invention, virtually any beverage container and drinking vessel could be used. For example, the bottle could be replaced with a soda or beer can 113 with the leading edge 114 of the can 113 resting on the prongs 61 with the bottle seat member 65 cradling a portion of the vessel portion 115 of the can 113 as shown in FIG. 21.

What is claimed:

1. A decorative fountain, comprising:

a first container resembling a drinking vessel;

a second container resembling a beverage container and having a base connected to a sidewall forming a vessel portion defining a hollow vessel, said base defining an inlet opening therethrough;

an overflow container defining a reservoir and an outlet in fluid communication with said reservoir;

a support surface positioned over said reservoir for supporting said first container, said support surface defining an aperture for communicating fluid into said reservoir;

a support conduit defining a passageway for fluid and having a first end fluidly connected to said outlet and an opposite end defining an aperture, said passageway in fluid communication with said outlet and said aperture;

a bottle inlet in fluid communication with said support conduit, said bottle inlet matable with said inlet opening so that said aperture is in fluid communication with said vessel;

a pump disposed within said reservoir, said pump operable to pump fluid from said reservoir through said outlet, said passageway and said bottle inlet and into said vessel; and a telescoping frame member projecting from said support conduit; said frame member including an inner member slidably supported within an outer member, a securing element for holding said inner and outer members in an adjustable relation to accommodate containers of differing lengths, a bottle catch member attached to one of said inner and outer members and configured to support said second container with a portion of said second container resting against said bottle catch member, a bottle seat member attached to the one of said inner and outer members between said bottle catch member and said support conduit and positioned to hug a portion of said vessel portion of said second container, and said frame positioned to hold said second container angled downwardly in a pouring position with the mouth of said second container disposed so that a stream of fluid flowing from said second container will fall into said first container when said first container is resting on said support surface.

2. The fountain of claim 1 wherein said support conduit includes a support base portion adjacent said first end, said support base portion configured, together with said overflow container, to support the fountain on a surface.

3. The fountain of claim 2 further comprising a foot member perpendicularly connected to said base portion.

4. The fountain of claim 2 wherein said support conduit includes a vertical portion rising from a turn adjacent said support base portion and said opposite end is turned to position said aperture above said overflow container and in line with said support surface.

5. The fountain of claim 1 wherein said second container further having a reduced neck portion terminating at a mouth and a shoulder portion between said vessel portion and said neck portion.

6. The fountain of claim 5 wherein said bottle catch member is a pair of prongs sized to straddle said neck of said second container with said shoulder portion of said second container resting against said prongs.

7. The fountain of claim 1 wherein said first container is configured to resemble a beverage can.

8. The fountain of claim 6 wherein inner member terminates with said bottle catch member.

9. The fountain of claim 1 wherein said outer member is connected to said support conduit and said bottle seat member is attached to said outer member.

10. The fountain of claim 5 wherein:

said frame member terminates with said bottle securing member and said bottle securing member is a pair of prongs sized to straddle said neck of said second container with said shoulder portion of said second container resting against said prongs; and said outer member is connected to said support conduit and said bottle seat member is attached to said outer member.

11. The fountain of claim 1 wherein said securing element is a thumbscrew.

12. The fountain of claim 1 wherein said bottle inlet has a cross-sectional dimension larger than a dimension of said inlet opening, said bottle inlet being a flexible material compressible for placement through said inlet opening and resilient to return towards an uncompressed state to establish a frictional relationship between said inlet opening and said bottle inlet to form a fluid tight seal.

13. The fountain of claim 12 wherein said material of said bottle inlet is transparent.

14. The fountain of claim 1 wherein said support surface defines a plurality of apertures.

15. The fountain of claim 1 wherein said first container resembles a martini glass and said second container resembles a vodka bottle.

16. An assembly for use with a drinking vessel and a beverage container to form a continuous fountain, the beverage container having a base connected to a sidewall forming a vessel portion to define a hollow vessel, the base defining an inlet opening therethrough, the assembly comprising:

an overflow container defining a reservoir and an outlet in fluid communication with said reservoir;

a support surface positioned over said reservoir for supporting the drinking vessel, said support surface defining an aperture for communicating fluid into said reservoir;

a support conduit defining a passageway for fluid and having a first end fluidly connected to said outlet and an opposite end defining an aperture, said passageway in fluid communication with said outlet and said aperture;

a bottle inlet in fluid communication with said support conduit, said bottle inlet configured to mate with the inlet opening defined through the base of the beverage container so that said aperture is in fluid communication with the vessel;

a pump disposed within said reservoir, said pump operable to pump fluid from said reservoir through said outlet, said passageway and said bottle inlet and into the vessel;

a telescoping frame member projecting from said support conduit; said frame member including an inner member slidably supported within an outer member, a securing element for holding said inner and outer members in an adjustable relation to accommodate bottles of differing lengths, a bottle catch member attached to one of said inner and outer members and configured to rest against a portion of the beverage container, a bottle seat member attached to the one of said inner and outer members between said bottle catch member and said support conduit and positioned to hug a portion of the vessel portion of the beverage container, and said frame positioned to hold the beverage container angled downwardly in a pouring position with a mouth of the beverage container disposed so that a stream of fluid flowing from the beverage container will fall into the drinking vessel when the drinking vessel is sitting on said support surface.

17. The assembly of claim 16 wherein said support conduit includes a support base portion adjacent said first end, said support base portion configured, together with said overflow container, to support the assembly on a surface.

18. The assembly of claim 15 further comprising a foot member perpendicularly connected to said base portion.

19. The assembly of claim 17 wherein said support conduit includes a vertical portion rising from a turn adjacent said support base portion and said opposite end is turned to position said aperture above said overflow container and in line with said support surface.

20. The assembly of claim 16 wherein the second container is bottle shaped having a reduced neck portion terminating at a mouth and a shoulder portion between the vessel portion and the neck portion and said bottle securing member is a pair of prongs sized to straddle the neck with the shoulder portion of the second container resting against the prongs.

21. The assembly of claim 16 wherein inner member terminates with said bottle catch member.

22. The assembly of claim 16 wherein said outer member is connected to said support conduit and said bottle seat member is attached to said outer member.

23. The assembly of claim 20 wherein:

said frame member terminates with said bottle securing member and said bottle securing member is a pair of prongs sized to straddle the neck of the beverage container with the shoulder portion of the beverage container resting against said prongs; and said outer member is connected to said support conduit and said bottle seat member is attached to said outer member.

24. The assembly of claim 16 wherein said securing element is a thumbscrew.

25. The assembly of claim 16 wherein said bottle inlet has a cross-sectional dimension larger than a dimension of the inlet opening, said bottle inlet being a flexible material compressible for placement through the opening of the bottle and resilient to return towards an uncompressed state to establish a frictional relationship between the inlet opening and said bottle inlet to form a fluid tight seal.

26. The assembly of claim 25 wherein said material of said bottle inlet is transparent.

27. The assembly of claim 16 wherein said support surface defines a plurality of apertures.

28. The assembly of claim 16 wherein said first container resembles a martini glass and said second container resembles a vodka bottle.

29. A decorative fountain kit, comprising:

a set of first containers each resembling a different drinking vessel;

a set of second containers each resembling a beverage container corresponding in appearance to one of said first containers, each of said second containers having a base connected to a sidewall forming a vessel portion defining a hollow vessel, said base defining an inlet opening therethrough; and an assembly of claim 16.

30. The kit of claim 29 wherein said set of first containers includes drinking vessels resembling at least one of a martini glass, a wineglass, an apertif glass, a brandy glass and a beer glass.

31. The kit of claim 18 wherein said set of second containers includes beverage containers resembling at least one of a liquor bottle, a wine bottle, a liquor bottle, a brandy bottle, a beer bottle, a soda can and a beer can.

* * * * *

UNITED STATES PATENT AND TRADEMARK OFFICE

CERTIFICATE OF CORRECTION

PATENT NO. : 6,530,530 B1
DATED : March 11, 2003
INVENTOR(S) : Joseph C. Peterson It is certified that error appears in the above-identified patent and that said Letters Patent is hereby corrected as shown below:

Column 4,
Line 52, omit "is"

Signed and Sealed this

Ninth Day of September, 2003

JAMES E. ROGAN
*Director of the United States Patent and Trademark Office*